United States Patent [19]

Ross

[11] 3,977,217

[45] Aug. 31, 1976

[54] FRICTION TWIST KNITTING ELEMENT

[75] Inventor: William Alden Ross, Harwinton, Conn.

[73] Assignee: The Torrington Company, Torrington, Conn.

[22] Filed: June 1, 1971

[21] Appl. No.: 148,822

[52] U.S. Cl. ..... 66/124

[51] Int. Cl.[2] ..... D04B 35/04

[58] Field of Search ..... 66/124, 123

[56] References Cited

UNITED STATES PATENTS

| | | | |
|---|---|---|---|
| 668,833 | 2/1901 | Gilbert | 66/124 X |
| 2,740,276 | 4/1956 | Minton | 66/124 X |

OTHER PUBLICATIONS

*Needle Characteristics*, J. T. Speetjens, The Hosiery Trade Journal, Mar. 1968, vol. 75, No. 891, pp. 117–120.

*Primary Examiner*—Mervin Stein
*Assistant Examiner*—Andrew M. Talik
*Attorney, Agent, or Firm*—Frank S. Troidl

[57] ABSTRACT

This is a knitting machine element for use in the slots of machines for circular knitted fabrics. The element is twisted so as to press it against the slot walls to produce a uniform pressure and predictable positioning of the element thereby eliminating rocking, misalignment, and improving frictional characteristics.

2 Claims, 6 Drawing Figures

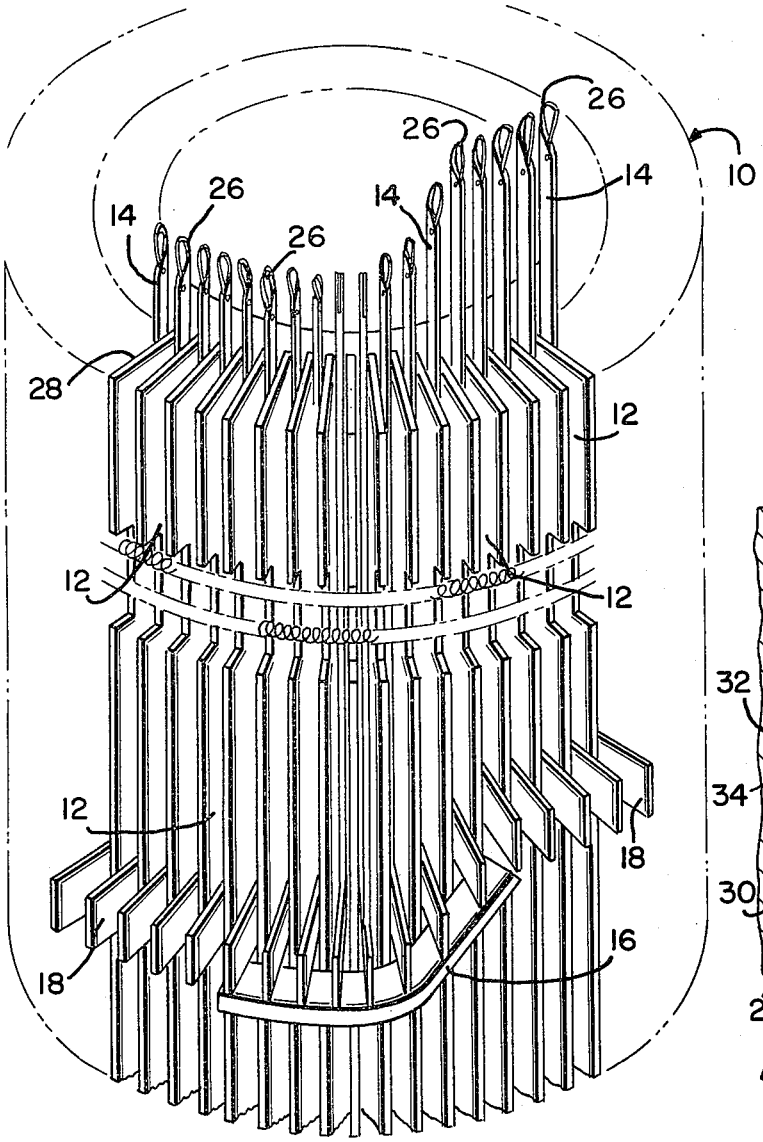
FIG. 1
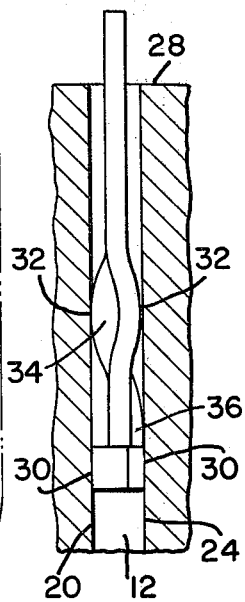
FIG. 5
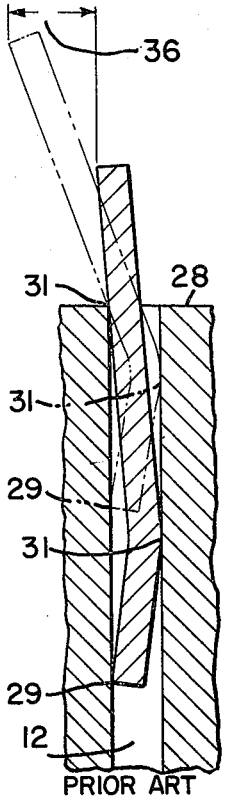
PRIOR ART
FIG. 4
FIG. 6
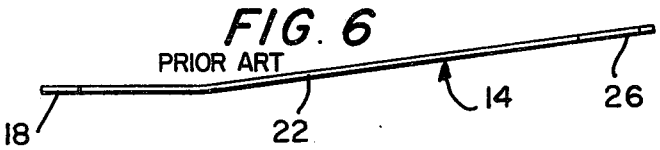
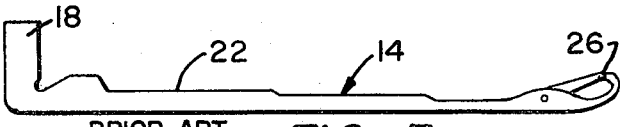
PRIOR ART
FIG. 3
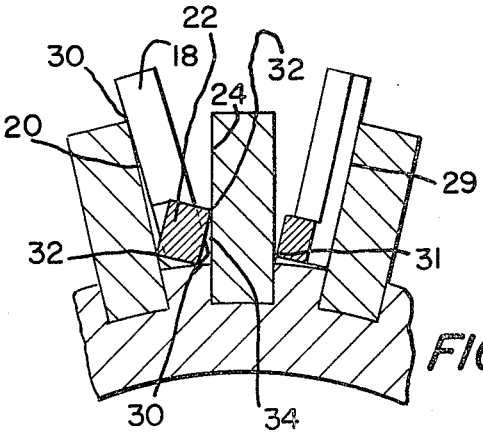
FIG. 2
INVENTOR
WILLIAM A. ROSS
BY
Frank S. Troidl
ATTORNEY

FRICTION TWIST KNITTING ELEMENT

This invention relates to knitting machine elements. More particularly, the invention is a new and improved needle or jack for use in the slots of machines where uniform friction and alignment are desirable.

In the manufacture of hosiery and other circular knitted fabrics, the knitting industry uses a needle cylinder with longitudinal slots arranged peripherally for the axial movement of knitting needles. Each knitting machine uses over 400 needles and runs at a speed that produces a stocking in minutes. The needles have a hook and latch which project varying amounts beyond the edge of the cylinder, and occasionally into elements called transfer jacks which have an appendage to receive the hooks. The major part of the needle resides between the walls of slots and are restrained from falling out of the cylinder radially by spring bands. The axial movement of the needles is controlled by external cams which press against the butts of the needles. Butts are projections from the ends opposite the hooks and latches which extend radially beyond the circumference of the cylinder. A straight needle would fit very loosely between the retaining walls and since the needle cylinder is mounted vertically in a knitting machine such a needle would simply fall to the bottom of the cylinder slot. In the present state of the art, the needles are restrained from falling by a friction bend, which is an angular deformation designed only to create a small amount of frictional pressure against the slot wall. This pressure must be sufficient to prevent unwanted movement of the needle due to gravitational and vibrational forces, or due to inertia of the needle when acted upon by the cams. The arrangement of the cams determines the needle action which in turn determine the pattern produced in the knitted fabric. As the needle cylinder rotates there are periods of time when the needle butt is not in contact with any cam. Were there no friction bend in the needle, the needle would either continue in its course, propelled by its momentum, or fall in the slot and no longer be of any use. For uniformity of product, positive positioning of the needle is necessary.

While smooth machine operation demands uniform friction bends, small variations in material thickness, or excessive wear on the needles and consequent adjustments of them result in nonuniformity of friction bends. This presents alignment problems which adversely affect the feeding of the yarn to the hooks, and restricts machine speed and performance. Producing and controlling uniform friction bends is time consuming and exacting. Nonuniform bends also cause variations in the frictional drag on the needles which has the unwanted effect of varying loop sizes in the knitted fabric.

It has been found that a friction bend needle tends to have much lower dynamic friction than static friction. After continuous operation the dynamic friction is reduced still more requiring machine adjustments and considerable machine downtime. Typically, this loss has been compensated by forming a greater bend in the needle, but this has the disadvantage of resulting in a higher static friction which makes a machine harder to start. With banks of machines there is a consequent increase in horsepower requirement and stronger drive train systems which in turn increase the purchase cost of a knitting machine. Derivative requirements include increased air conditioning capacity and extra load electrical service. However, the friction twist needle does not suffer a great loss of friction after continuous operation. The constant dynamic friction characteristics permit machine design with lower static friction and the avoidance of these problems.

For replaceability the slots are made by radial insertion of flat pieces into the cylinder. The bend in the needle also causes rocking of the needle from one restraining wall to the other when the machine vibrates, due to the radial divergence of the retaining walls. Similarly, as the butts engage and disengage with the cam surface, the hook of the needle rocks back and forth interfering with the feeding of the yarn to the hook. Also, as the hook moves from the end of the cylinder towards the transfer jack, the exposed portion of the needle has nothing to support it and tends to lean away from the bend in the needle. If the bends in the needles are nonuniform in position along the length of the needle or amount of angle, the amount of lean will vary. This creates alignment problems with the transfer jack, into which the needle must be inserted.

Finally, the bend has the effect of wiping lubrication from the slot walls. When running dry, the needle generates heat and wears more rapidly at the bend. This wear reduces the frictional force of the needle and eventually reduces the life of the needle requiring more frequent adjustments and consequent downtime of the machine.

I have discovered that the addition of a friction twist to the needle abolishes the need for a friction bend and most of the problems related thereto. By twisting the needle along its longitudinal axis to produce a permanent set, more uniform and consistent frictional characteristics can be built into the needle. Further advantages are that the alignment of the needle can be more precisely controlled, and its lubricant wiping tendency can be modified. This has the added advantage of increasing cylinder wall life and providing a smoother running machine. Furthermore, because the friction twist needle is axially straighter than a friction bend needle, it is easier to install and remove from the knitting machine cylinder. This results in less hook damage during installation, and decreased downtime for the same number of needle replacements.

While the foregoing has described the invention as a needle, it is to be understood that this invention is not limited to application with knitting needles, as there are many other machine elements which slide in slots in both circular and flat bed knitting machines and requires a controlled amount of friction and to which this concept can be applied. To name a few, there are jacks, cylinder jacks, pattern jacks, transfer jacks, blanks, bluffs, spreaders, pattern butts, grooved hooks, transfer cast offs, and drum jacks.

BRIEF DESCRIPTION OF THE DRAWINGS

In the following description and in the claims parts will be identified by specific names, but such names are intended to be as generic in their application to similar parts as the art will permit. Like reference characters denote like parts in the several figures of the drawings in which:

FIG. 1 is a perspective view of a knitting machine cylinder with some of the needles protruding from the slots;

FIG. 2 is a partial transverse cross section of a knitting cylinder showing a friction twist and a friction bend needle seated in two of the slots, looking from point of contact with slot toward the butt;

FIG. 3 is a longitudinal elevation of a knitting needle without bend or twist;

FIG. 4 is a partial section plan view of a friction bend knitting needle in a cylinder slot;

FIG. 5 is a plan view of a friction twist knitting needle with a double twist in a cylinder slot; and FIG. 6 is a plan view of a conventional friction bend needle.

Referring particularly to FIGS. 1 and 2 it can be seen that a knitting machine cylinder 10 has a circumferentially distributed series of slots 12 in which knitting needles 14 are moved axially by the action of a cam 16 on the needle butts 18. Butt 18 is rectangular in cross-section with a long axis and a short axis. The twist presses the butt against one wall of the slot 20 while the body of the needle 22 bears against the other wall 24 (See FIG. 2). Alternatively, the butt of the needle may be positioned on the center line of the slot while different sections of the body bear on the opposite walls of the slot.

The hook 26 tends to deflect laterally from its axial path an amount 36 when a conventional needle projects beyond the cylinder edge 28 as is shown by the phantom lines in FIG. 4. The lower portion of the conventional needle contacts the slot wall at point 29. The other contact points are indicated by number 31. In a twist needle the butt bearing points 30 and body bearing points 32 exert a torsional moment which eliminates this problem. The axial movement of the needle hook is straighter, alignment with a mating machine element called a transfer jack is improved, and the machine will run smoother. Further, if the axial distance between the bearing points is held constant, the frictional force against the slot walls will be uniform.

A friction twist needle creates a lubricant pocket 34 which captures oil and carries it along the slot during its reciprocal movements thereby lubricating the slot more dependably than the friction bend needle. Such improved lubrication will result in longer needle life and cylinder wall life and will contribute to a smoother running machine. As shown in FIG. 5, the twisted portion may include a clockwise twist 34 and a counterclockwise twist 36 when viewed from the butt end of the needle.

In operation, the cylinder 10 rotates, bringing the needle butt 18 into engagement with the cam 16 which moves the needle 14 along the slot 12 and projects the hook 26 beyond the cylinder edge 28. The twist maintains a uniform torsional pressure on the butt 18 which prevents rocking, and maintains a constant axial distance between contact points 30 and 32 which eliminates lateral hook displacement 36.

The torsional pressure results in a uniform friction force which stops the axial movement of the needle when it is not engaged with a cam. During needle movement, a drop of lubricant trapped in a lube pocket 34 formed between the twist and the slot lubricates and cools the slot walls.

I claim:

1. A needle for use in a slot having two side walls of a knitting machine cylinder comprising: an elongated body with a rectangular cross section, a butt at one end of the elongated body with a known cross section having a short axis and a long axis, a hook and latch at the other end of the elongated body, said elongated body having a plurality of twisted portions on its lower portion and extending along a minor portion of the longitudinal axis of the elongated body, the amount of the twists being such that the twisted portions will flexibly press against the walls of the slot with a certain frictional force and the butt will press up against at least one wall of the slot with a certain frictional force whereby as the needle is reciprocated the twisted portions and butt will flexibly press against the walls of the slot with a uniform frictional force and the hook and latch will stay in a plane which is generally parallel to the side walls along the center line of the slot.

2. The needle of claim 1 wherein at least one twist is clockwise when viewed from the butt end of the needle and at least one twist is counterclockwise.

* * * * *